US006049052A

United States Patent [19]

Chutjian et al.

[11] Patent Number: 6,049,052

[45] Date of Patent: Apr. 11, 2000

[54] MINIATURE MICROMACHINED QUADRUPOLE MASS SPECTROMETER ARRAY AND METHOD OF MAKING THE SAME

[75] Inventors: Ara Chutjian, La Crescenta; Stephen D. Fuerstenau, Montrose; Otto J. Orient, Glendale; Karl Y. Yee; John T. Rice, both of Pasadena, all of Calif.

[73] Assignee: California Institute of Technology, Pasadena, Calif.

[21] Appl. No.: 09/305,807

[22] Filed: Apr. 28, 1999

Related U.S. Application Data

[63] Continuation of application No. 09/089,781, Jun. 3, 1998, abandoned

[60] Provisional application No. 60/048,540, Jun. 3, 1997.

[51] Int. Cl.[7] ..... H01J 49/42

[52] U.S. Cl. ..... 219/69.12; 250/292

[58] Field of Search ..... 219/69.12, 69.17; 250/292, 396 R

[56] References Cited

U.S. PATENT DOCUMENTS 5,384,461 1/1995 Jullien et al. ..... 280/292

5,852,270 12/1998 Holkeboer ..... 219/69.12

*Primary Examiner*—Kiet T. Nguyen

*Attorney, Agent, or Firm*—Fish & Richardson P.C.

[57] ABSTRACT

The present invention provides a quadrupole mass spectrometer and an ion filter, or pole array, for use in the quadrupole mass spectrometer. The ion filter includes a thin patterned layer including a two-dimensional array of poles forming one or more quadrupoles. The patterned layer design permits the use of very short poles and with a very dense spacing of the poles, so that the ion filter may be made very small. Also provided is a method for making the ion filter and the quadrupole mass spectrometer. The method involves forming the patterned layer of the ion filter in such a way that as the poles of the patterned layer are formed, they have the relative positioning and alignment for use in a final quadrupole mass spectrometer device.

92 Claims, 5 Drawing Sheets

MINIATURE MICROMACHINED QUADRUPOLE MASS SPECTROMETER ARRAY AND METHOD OF MAKING THE SAME

CROSS-REFERENCE TO RELATED APPLICATIONS

This application claims the benefit of priority under 35 U.S.C. § 119 to U.S. Provisional Patent Application No. 60/048,540, filed June 3, 1997. The entire contents of U.S. Provisional Patent Application No. 60/048,540 are incorporate herein, as if set forth herein in full.

ACKNOWLEDGMENT OF GOVERNMENT SUPPORT

The invention described herein was made in the performance of work under a NASA contract and is subject to the provisions of Public Law 96–517 (35 U.S.C. 202) in which the Contractor has elected to retain title.

FIELD OF THE INVENTION

The present invention generally relates to quadrupole mass spectrometers. In particular, the present invention relates to a miniature micromachined ion filter for use in a quadrupole mass spectrometer, a quadrupole mass spectrometer including the ion filter, and methods of making the ion filter and the quadrupole mass spectrometer.

BACKGROUND OF THE INVENTION

Mass spectrometers are workhorse instruments finding applications in many commercial and military markets, with potential for use in domestic markets as well. A mass spectrometer is able to sample, in situ, the atmosphere in which it is placed and provide a reading of the atomic and molecular species (and any positive or negative ions) present in that atmosphere and of the absolute abundance of these species.

There are many types of mass spectrometers, such as magnetic sector, Paul or Penning ion trap, trochoidal monochromator, and the like. One popular type of mass spectrometer is the quadrupole mass spectrometer (QMS), first proposed by W. Paul (1958). In general, the QMS separates ions with different masses by applying a direct current voltage and a radio frequency ("RF") voltage on four rods having hyperbolic or circular cross sections and an axis equidistant from each rod. Opposite rods have identical potentials. The electric potential in the quadrupole is a quadratic function of the coordinates.

Ions are introduced in a longitudinal direction through a circular entrance aperture located at the ends of the rods and centered on the midpoints between rods. Ions are deflected by the field depending on their atomic mass-to-charge (m/z) ratio. By selecting the applied voltage amplitude and frequency of the RF signal, only ions of a selected m/z ratio exit the QMS along the axis of a quadrupole at the opposite end and are detected. Ions having other m/z ratios either impact the rods and are neutralized or deflect away from the centerline axis of the quadrupoles.

As explained in Boumsellek, et al. (1993), a solution of Mathieu's differential equations of motion in the case of round rods provides that to select ions with a m/z ratio using an RF signal of frequency f and rods separated by a contained circle of radius distance $R_0$ the peak RF voltage $V_0$ and DC voltage $U_0$ should be as follows:

$$V_0=7.233mf^2R^2_0$$

$$U_0=1.213mf^2R^2_0$$

Conventional QMS's weigh several kilograms, have volumes of the order of $10^4$ $cm^3$, and require 50–100 watts of power. Further, these devices usually operate at vacua in the range of $10^{-6}$–$10^{-8}$ torr in order that the mean free path be comparable to the instrument dimensions, and where secondary ion-molecule collisions cannot occur. Commercial QMS's of this design have been used for characterizing trace components in the atmosphere (environmental monitoring), automobile exhausts, chemical-vapor deposition, plasma processing, and explosives/controlled-substances detection (forensic applications). However, such conventional QMS's are not suitable for spacecraft life-support systems and certain national defense missions where they have the disadvantages of relatively large mass, volume, and power requirements. A small, low-power QMS would find a myriad of applications in factory air-quality monitoring, pollution detection in homes and cars, protection of military sites, and protection of public buildings and transportation systems (e.g., airports, subways, and harbors) against terrorist activities.

One type of miniature QMS (Pat. No. 5,401,962) was developed by Ferran Scientific, Inc., San Diego, Calif. and includes a miniature array of sixteen rods comprising nine individual quadrupoles. The rods are supported only at the detector end of the QMS by means of powdered glass that is heated and cooled to form a solid support structure. The electric potential and RF voltage are applied by the use of springs contacting the rods. The Ferran QMS dimensions are approximately 2 cm diameter by 5 cm long, including a gas ionizer and detector, and has an estimated mass of 50 grams. The reduced size of the Ferran QMS results in several advantages over existing QMS's, including a reduced power consumption and a higher operating pressure.

The Ferran QMS has a resolution of approximately 1.5 amu in the mass range 1–95 amu. This is a relatively low resolution for a QMS, making the miniature Ferran QMS useful for commercial processing (e.g., chemical-vapor deposition, blood-plasma monitoring) but not for applications that require accurate mass separation, such as in analytical chemistry and in spacecraft life-support systems. Boumsellek et al. (1993) traced the low resolution to the fact that the rods were aligned only to within a ±3% accuracy, whereas an alignment accuracy in the range of ±0.1% is necessary for a high resolution QMS.

A separate miniature QMS (Pat. Nos. 5,596,193 and 5,719,393) was developed by the Jet Propulsion Laboratory (JPL), California Institute of Technology to address the continuing need for a reduced size QMS having an acceptable rod alignment. The JPL QMS provides improved resolution over the Ferran QMS due to improved accuracy in rod alignment. As may be appreciated, the accurate positioning and alignment of individual miniature rods in an array significantly increases the cost of manufacturing due to the increased time and specialized equipment required for precisely aligning separate miniature rods. As the size of the rods is further reduced, the complexity, difficulty and expense of rod positioning and alignment increases. In this regard, there is a need for a small QMS having high resolution that may be made by simpler and less expensive manufacturing process.

SUMMARY OF THE INVENTION

In one aspect, the present invention provides a quadrupole ion filter, and a quadrupole mass spectrometer including the ion filter, that avoids problems associated with miniaturization of conventional quadrupole mass spectrometer devices, and especially problems concerning the incorporation of loose rods into conventional devices. The ion filter includes a patterned layer of electrically conductive material, with the patterned layer including a two-dimensional array of poles for one or more quadrupoles. Alternatively, the ion filter may be described as a pole array. The pole array, or array of poles, in the pattern is two-dimensional in that the poles in the array have a regular spacing in the x-y plane, with the length of the poles in the array being in the z direction. The poles of the ion filter serve the same function as the rods in conventional quadrupole devices. The patterned layer is divided into a number of separate sections, or pieces, each including at one terminal end one pole in the array of poles. At the other terminal end of each separate piece is a bonding location for convenient electrical connection of the piece with an external power source.

Structurally, the quadrupole ion filter of the present invention is considerably different than the quadrupole structure in conventional quadrupole mass spectrometers. Conventional quadrupole mass spectrometers, even those that have been miniaturized, use poles that are in the form of individual longitudinally extending rods. The ion filter of the present invention, however, includes the array of poles in a thin patterned layer, with the thickness of the layer corresponding with the length of the poles.

The patterned layer in the ion filter of the present invention typically has a thickness of smaller than about 6 millimeters, although even smaller thicknesses may be preferred for some applications. In that regard, the thinner that the patterned layer is, the shorter the length of poles and, therefore, the shorter the distance that ions must travel to pass through the ion filter. A shorter length of travel through the ion filter permits operation at higher pressures, which is a significant advantage with the ion filter of the present invention.

By use of the patterned layer in the ion filter of the present invention, it is possible to make the poles of an extremely small size and with an extremely dense spacing. For example, with the present invention, the density of poles in the patterned layer is typically greater than about 2 poles per square millimeter, and in many embodiments the density is much higher. Furthermore, directly opposing poles in the patterned layer are typically separated by a distance of shorter than about 0.2 millimeter, and in many embodiments by an even shorter distance. Diagonally opposing poles in the patterned layer are typically separated by a distance of shorter than about 0.3 millimeter, and in many embodiments by an even shorter distance. Because of the extremely small size and dense spacing of the poles, the ion filter may include a large array of poles in a small space, with different groupings of four adjacent poles each defining a channel for passage of ions. With the present invention, however, these quadrupole channels are extremely small. When the ion filter includes a large array of poles, defining a plurality of quadrupole channels, the channels are typically present in a density of larger than about one of the quadrupole channels per square millimeter, and often greater than two of the quadrupole channels per square millimeter.

An advantageous structure for the ion filter of the present invention is one in which substantially all of the patterned layer is supported by a single, common supporting substrate, which is typically of dielectric material. The patterned layer is such, however, that a portion of the patterned layer that includes the poles is suspended from the substrate. Typically, the suspended portion of the patterned layer extends over an opening that passes through the substrate. In this way, the opening provides a passageway to permit ions access to the quadrupole channels. The patterned layer is bonded to the supporting substrate in a manner that maintains positioning and alignment of the poles, even though the poles are suspended from the substrate.

A significant aspect of the present invention is manufacture of the quadrupole ion filter, and manufacture of quadrupole mass spectrometers including the ion filter. According to the present invention, a method is provided in which the poles in the patterned layer are made in a manner such that as the poles are made they have relative positioning and alignment for final use in a quadrupole mass spectrometer. This is typically accomplished, according to the method of the present invention, by forming the patterned layer of the ion filter on a common supporting substrate so that the patterned layer, as formed on the common supporting substrate, is bound to the substrate, such that the relative positioning and alignment of poles in the patterned layer is thereby fixed.

One preferred embodiment of the method for manufacturing the ion filter involves simultaneous manufacture of the patterned layer, including the poles, by filling a mold with electrically conductive material. The mold includes a template for the patterned layer. The mold is filled when it is situated on the surface of the common supporting substrate. When the mold is then removed, the patterned layer remains supported by the common supporting substrate. In one embodiment, the mold may be made by a technique known as Lithographie-Galvanoformung-Abformung (LIGA) manufacture.

Another embodiment of the method for manufacturing the present invention involves forming the patterned layer from a single work piece, typically in the form of a metallic sheet, that has been bonded to the common supporting substrate. Material is selectively removed from the work piece to form the patterned layer, such that the patterned layer, as formed, is bound to and supported by the common supporting substrate. Typically, the selective removal of material from the work piece is accomplished by electrical discharge machining (EDM).

The present invention also involves a quadrupole mass spectrometer including the mass filter of the present invention. The quadrupole mass spectrometer includes the ion filter located between an ion source and an ion detector. During operation, the ion source supplies ions to be filtered by the ion filter. Ions passing through the ion filter may then be detected by the ion detector. The quadrupole mass spectrometer may include spacers before and/or after the ion filter to maintain a predetermined spacing between the ion filter and the ion source and/or the ion detector and to assist in isolating the operation of the ion filter from influences from other components. These spacers are typically made of dielectric material. The quadrupole mass spectrometer may also include entrance and/or exit devices for enhancing performance of the quadrupole mass spectrometer. The entrance device is located between the ion source and the ion filter and typically includes a body of dielectric material having apertures therethrough for channeling ions from the ion source into the ion filter. In a preferred embodiment, the entrance device includes an electrically conductive metallic film at least on a side facing the ion source, to dissipate the charge of ions striking the entrance device. The exit device similarly includes a body of dielectric material having apertures therethrough for channeling ions exiting the mass filter to the ion detector. In a preferred embodiment, the exit device includes an electrically conductive metallic film on at least a side facing the ion filter, to dissipate the charge of ions striking the exit device.

Furthermore, the quadrupole mass spectrometer has a versatile design that may be adapted to a variety of situations. For example, a Faraday-type ion detector may be used for operation at relatively high pressures, often in the millitorr range. For operation of the device at very low pressures, such as those below about $10^{-4}$ torr, a single particle multiplier may be used as the ion detector.

Also, according to the present invention, the quadrupole mass spectrometer including the ion filter may easily be manufactured through proper alignment and assemblage of the individual components.

DETAILED DESCRIPTION

The present invention provides a quadrupole mass spectrometer comprising an ion source, an ion filter, and an ion detector, useful for in situ sampling of an atmosphere for identification of atomic and molecular species that may be present in the atmosphere. The present invention also includes an ion filter for use in the quadrupole mass spectrometer including an array of at least 4 miniature poles defining at least one quadrupole channel through which ions pass for detection. This ion filter can may also be described as a pole array. The pole array, or array of poles is typically used to perform the ion filtering function in the mass filter component of the quadrupole mass spectrometer. The ion filter typically comprises a sufficiently large two-dimensional array of poles to define a plurality of quadrupole channels in a quadrupole mass spectrometer array (QMSA). Having a plurality of quadrupole channels is advantageous to enhance detection sensitivity, especially for the miniature device of the present invention because the detection sensitivity associated with a quadrupole channel generally decreases with decreasing channel size, due to the smaller cross-sectional area of the channel that is available for passage of ions.

Figure 1:
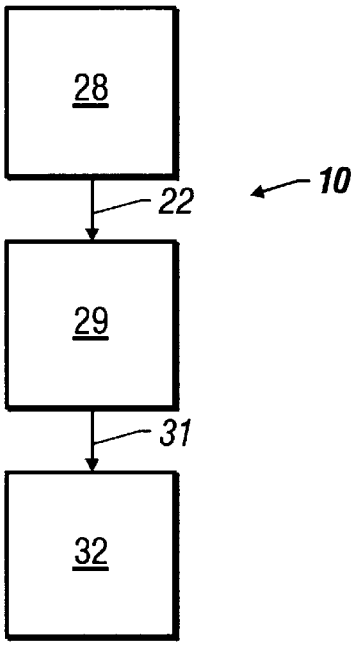
FIG. 1 is a block diagram showing major components of one embodiment of a quadrupole mass spectrometer of the present invention.

Referring now to FIG. 1 the major components of the quadrupole mass spectrometer of the present invention are shown. As illustrated in FIG. 1, a miniature micromachined quadrupole mass spectrometer 10 is shown including an ion source 28, an ion filter 29, and an ion detector 32. The mass spectrometer 10 operates according to known principles. During operation, the ion source 28 provides ions in an ion beam 22. Ions in the ion beam 22 travel to the ion filter 29 where ions are filtered according to the m/z ratio of the ions, with m referring to the mass of an ion and z referring to the charge of an ion. Mass filtered ions 31 exiting the ion filter 29 may then be detected by the ion detector 32. At any given time, the mass filtered ions 31 include substantially only ions in a narrow range of m/z ratios, so that the ion detector 32, at any given time, is detecting only ions within the narrow range. The location of the m/z range of the mass filtered ions 31 may be periodically or continuously varied by varying RF frequency and voltages to the ion filter 29, as discussed further below, using control electronics known in the art. In this way, the mass spectrometer may be used to detect ions over a wide range of m/z values. Information from the ion detector 32 concerning detected ions may be interpreted by techniques known in the art for identification of atomic and molecular species originally present in the atmosphere being sampled by the mass spectrometer 10.

The ion source 28 may be any apparatus capable of generating ions for filtering in the ion filter 29. Examples of the ion source 28 include a field-emission ionizer and an electron-impact ionizer. Preferred as the ion source 28 is an electron-impact ionizer.

The ion detector may be any apparatus capable of detecting the mass filtered ions 31. Examples of the ion detector 32 include a Faraday-type ion detector, a single-particle multiplier and a flat micromachined plate. Preferred as the ion detector 32 is a miniature micromachined-plate ion multiplier.

The ion filter 29 includes the QMSA of the present invention as an active element for filtering ions for detection. The QMSA filters ions based on general principles well known in the operation of quadrupole mass spectrometers. The QMSA of the present invention, however, can be of an extremely small size, which is advantageous for many uses, especially when size or weight considerations are important, such as in space applications. Also, the QMSA of the present invention is manufacturable by micromachining techniques that lend themselves to relatively high volume, low cost manufacture.

Figure 2:
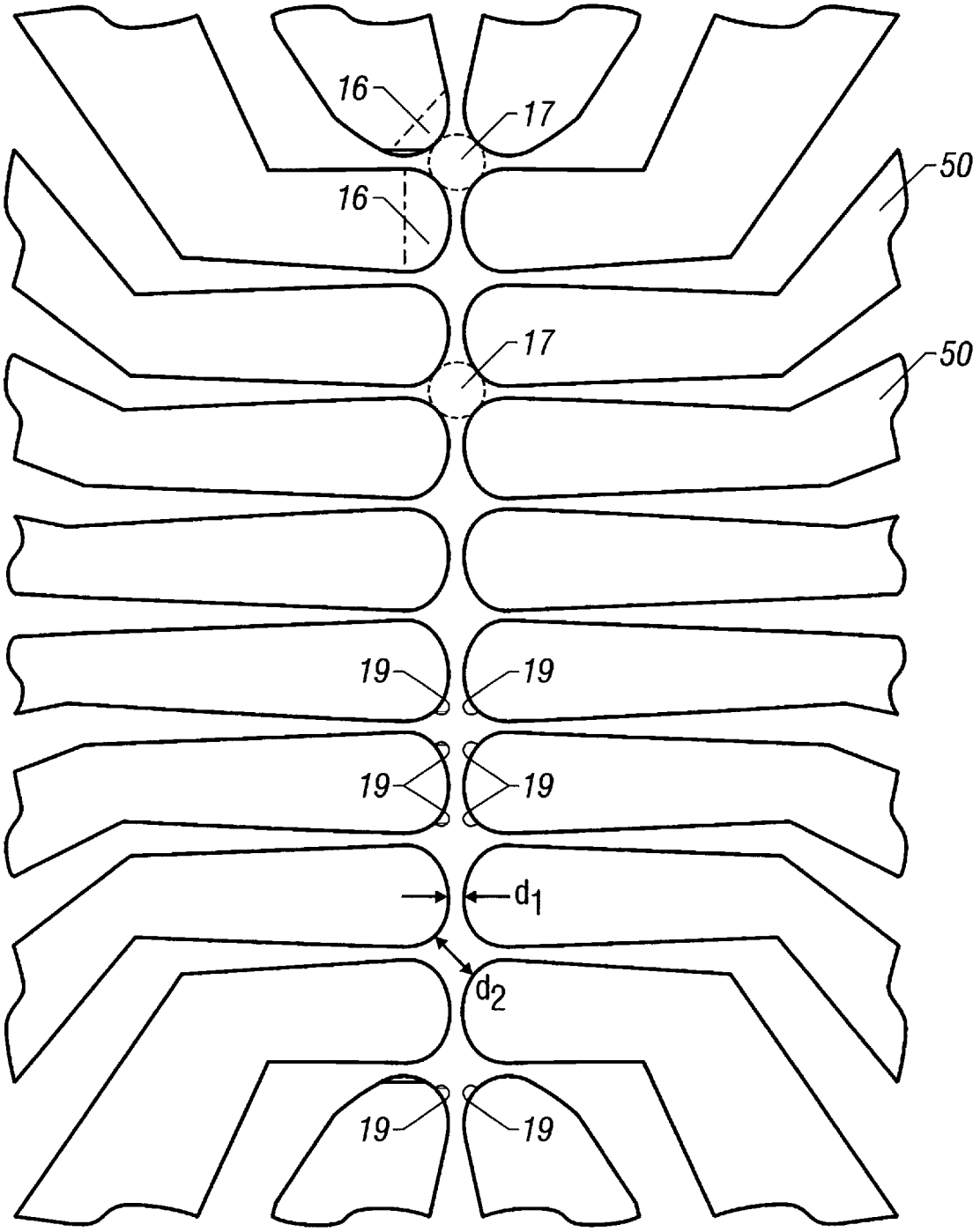
FIG. 2 is a partial top view, drawn to a large scale, of one embodiment of an array of poles in an ion filter of the present invention.

One embodiment of the QMSA of the present invention is shown in FIG. 2, including an array of poles 16, with any grouping of four adjacent poles 16 defining a quadrupole channel 17 through which ions travel during use. The quadrupole channel 17 refers to the space defined by any grouping of four poles 16 within areal boundaries defined by a circle that is substantially tangent to each of the four relevant poles 16, as exemplified by the dotted circles shown for two of the quadrupole channels 17 in FIG. 2. Each of the poles 16 form an integral structure with a connecting strip 50, which acts as an electrical lead to the respective one of the poles 16. Each of the poles 16, therefore, forms the terminal portion of an integral piece including one of the poles 16 and a corresponding connecting strip 50.

With continued reference to FIG. 2, each of the poles 16 has either one or two curved exterior surfaces 19, such that each of the quadrupole channels 17 has four of the curved surfaces 19 facing the quadrupole channel 17. The curved surfaces 19 as shown in FIG. 2 have a hyperbolic shape, which is preferred for the poles 16. Other surface shapes, could, however, be used, such as an arc of a circle.

In a conventional quadrupole mass spectrometer, the poles would be separate pieces, such as individual circular rods, assembled in an array. With reference to FIG. 2, the poles 16 of the QMSA of the present invention are significantly different than the poles in conventional quadrupole mass spectrometers, because the poles 16 are a terminal portion of a larger integral structure, as noted above. The terminal portions forming the poles 16 of the present invention generally include only the terminal portions of the integral structure generally within the area defined by the curved surfaces 19, as shown by the dotted lines shown for two of the poles 16 in FIG. 2. One significant advantage of the poles 16 of the present invention is their small size. Typically, the cross sectional area of the poles 16 (i.e., the terminal area inside of the dotted lines shown in FIG. 2) is smaller than about 0.3 square millimeter, preferably smaller than about 0.2 square millimeter and more preferably smaller than about 0.1 square millimeter.

A significant advantage of the QMSA of the present invention is the extremely small size and dense spacing of the poles 16 forming the array. With continued reference to FIG. 2, in a preferred embodiment, the face-to-face spacing (d1) between adjacent, directly opposing poles 16 is smaller than about 0.2 millimeter, preferably smaller than about 0.15 millimeter, and most preferably smaller than about 0.1 millimeter. Spacing (d2) between diagonally opposing poles 16 is preferably smaller than about 0.3 millimeter, more preferably smaller than about 0.25 millimeter, still more preferably smaller than about 0.2 millimeter and most preferably smaller than about 0.15 millimeter. According to the present invention, the density of quadrupoles in the QMSA is typically greater than about 2 quadrupoles per square millimeter, preferably greater than about 3 quadrupoles per square millimeter, more preferably greater than about 4 quadrupoles per square millimeter, and most preferably greater than about 5 quadrupoles per square millimeter, with the area measured in a plane perpendicular to the longitudinal axes of the quadrupoles in the array. As used herein, a quadrupole refers to the equipotential area, when the device is operating, in the area of a quadrupole channel 17 defined by any grouping of four adjacent of the poles 16 of the array. With such a high density of quadrupoles per cross-sectional area, the QMSA can easily accommodate 10 quadrupoles in devices designed for applications having even the tightest space requirements, and more preferably at least 100 quadrupoles. The density of poles 16 in the array is preferably greater than about 2 poles per square millimeter, more preferably greater than 4 poles 16 per square millimeter, still more preferably greater than about 6 poles 16 per square millimeter, and most preferably greater than about 8 poles 16 per square millimeter. Particularly preferred is a pole density in the array of greater than about 10 poles 16 per square millimeter. With the dense spacing of the adjacently located poles 16 and, thus, dense spacing of quadrupoles, the spacing density of the quadrupole channels 17 is typically one or more of the quadrupole channels 17 per square millimeter, and preferably more than about two of the quadrupole channels 17 per square millimeter. When the array of the poles 16 defines more than one quadrupole and, consequently more than one of the quadrupole channels 17, the number of poles 16 will be at least 6, and preferably at least 20 and more preferably at least 100. Furthermore, the area of each of the quadrupole channels 17 for accepting ions (i.e., the area of the exemplified inscribed circles in FIG. 2) is very small, typically smaller than about 0.05 square millimeter, preferably smaller than about 0.03 square millimeter and more preferably smaller than about 0.02 square millimeter.

The poles 16 of the array are positioned between the ion source 28 and the ion detector 32 of the quadrupole mass spectrometer such that substantially the entire length of each pole 16 is within the space between the ion source and the ion detector. The poles 16 preferably have a length of shorter than about 6 millimeters, more preferably a length of shorter than about 4 millimeters, even more preferably a length of shorter than about 3 millimeters. In one embodiment, the length of the poles 16 is shorter than about 2 millimeters.

Figure 3:
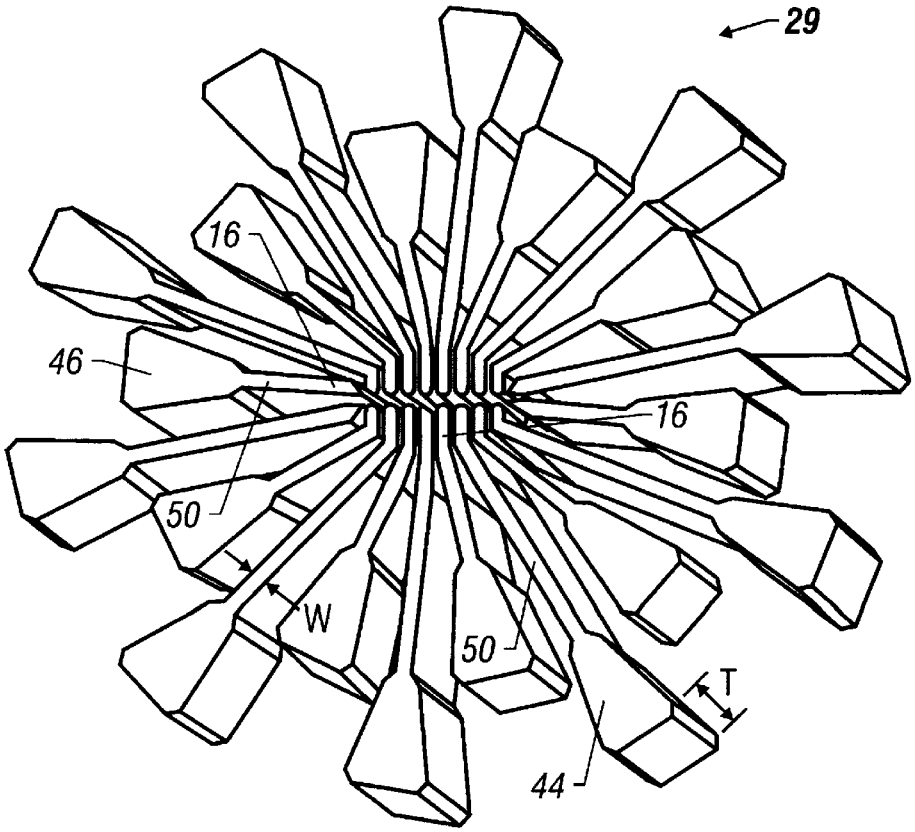
FIG. 3 is a perspective view of one embodiment of an ion filter of the present invention.

The QMSA is part of the ion filter 29 of the present invention. One embodiment of the ion filter 29 is shown in FIG. 3. The ion filter 29 includes a thin patterned layer of electrically conductive material, preferably of an electrically conductive metal such as gold or titanium. The patterned layer includes a plurality of elongated electrically conducting portions, each including in a single integral piece a pole 16, a bonding pad 44 or 46, and a connecting strip 50, with the connecting strip 50 being located intermediate between the pole 16 and the bonding pad 44 or 46.

The pole 16 is located at one terminal end of each integral piece, as previously described with reference to FIG. 2, and the bonding pad 44 or 46 is located at the opposite terminal end. The bonding pad 44 or 46 provides a location for making an electrical connection to an external power source for providing power to the array of the poles 16, and the connecting strip 50 provides an electrical lead from the bonding pad 44 or 46 to the pole 16. As shown, the bonding pad 44 or 46 has a greater width than the pole 16 or the connecting strip 50. Although not necessary to the present invention, having a wider area available for bonding is preferred for ease of making an electrical connection. Preferably, the bonding pad 44 or 46 is suitable for making a wire bond connection to an external power source.

Preferably, each of the integral pieces has a substantially constant layer thickness (shown as dimension T in FIG. 3) for all of the bonding pad 44 or 46, connecting strip 50 and pole 16. Furthermore, it is preferred that all of the integral pieces making up the patterned layer are of substantially the same thickness. A substantially constant thickness for the patterned layer facilitates ease of manufacture of the ion filter 29 and incorporation of the ion filter 29 into a quadrupole mass spectrometer. The thickness of the patterned layer is preferably substantially equal to the length of the poles 16. The connecting strips 50 preferably have a width (shown as dimension W in FIG. 3) of smaller than about 0.5 millimeter.

The patterned layer of the ion filter 29 is typically substantially all supported by a common substrate. This is important both from a manufacturing perspective, as discussed below, and from an operational perspective, due to the narrow tolerances achievable when the integral pieces for all of the poles 16 are supported by a common substrate. The common substrate is typically of a dielectric material. Examples of such dielectric materials include alumina and glass. Furthermore, the common substrate will typically include an opening over which the poles 16 and a portion of the connecting strips 50 are suspended. The opening forms part of a pathway for ions traveling through the device, as described more fully below. The ion filter 29 may be supported on either side of the common substrate, the side facing the ion source 28 or the side facing the ion detector 32.

Figure 4:
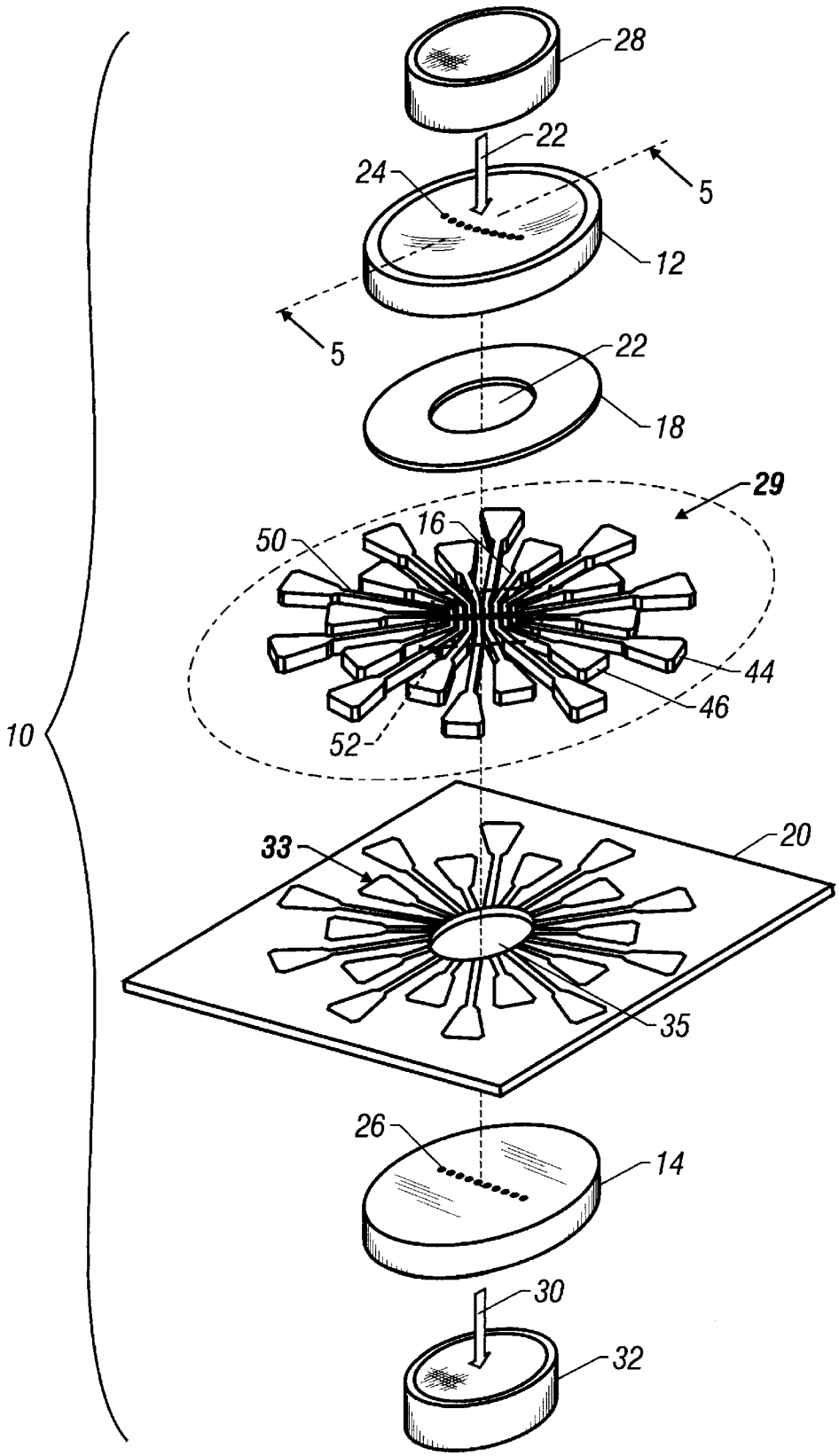
FIG. 4 is an exploded view in perspective illustrating several of the components and their arrangement in one embodiment of a quadrupole mass spectrometer of the present invention.

The ion filter 29 of the present invention may be incorporated into a quadrupole mass spectrometer in any convenient way. One preferred configuration is shown in FIG. 4, which is an exploded perspective view showing components of one embodiment of a miniature micromachined quadrupole mass spectrometer 10. As shown in FIG. 4, the quadrupole mass spectrometer 10 includes the ion source 28, the ion filter 29 and the ion detector 32. The mass spectrometer 10 also includes an entrance device 12, such as an entrance plate, for controlling the movement of ions in the ion beam 22 into the ion filter 29 and an exit device 14, such as an exit plate, for controlling the movement of the mass filtered ions 30 from the ion filter 29. The mass spectrometer 10 also includes an entrance spacer 18, and an exit spacer 20. During operation of the mass spectrometer 10, the entrance device 12 receives ions in the ion beam 22 from the ion source 28. Ions in the ion beam 22 pass through entrance apertures 24 extending through the entrance device 12 to channel ions into quadrupole channels 17 (as shown in FIG. 2) within the array of electrically conductive poles 16. The exit device 14 is located at a distal end from the entrance device 12 and provides ions with egress through exit apertures 26 extending through the exit device 14. The mass-filtered ions 30 pass to the ion detector 32 for detection.

The array of poles 16 of the ion filter 29 is located adjacent to and between the entrance device 12 and the exit device 14. The entrance spacer 18 maintains a predetermined spacing between the array of poles 16 and the entrance device 12. The exit spacer 20 maintains a predetermined spacing between the array of poles 16 and the exit device 14. The exit spacer 20 also acts as a common supporting substrate for the patterned layer of the ion filter 29. One or both of the spacers 18, 20 may be bonded to the structure of the ion filter 29 and to the entrance and exit devices 12, 14, respectively. As may be appreciated, many bonding methods, preferably non-contaminating bonding methods, such as diffusion- and anodic-bonding techniques, may be employed to obtain good bonding results. The spacers 18, 20 may have any convenient thickness, but typically each have a thickness of smaller than about 1 millimeter and preferably smaller than about 0.5 millimeter.

Figure 5:
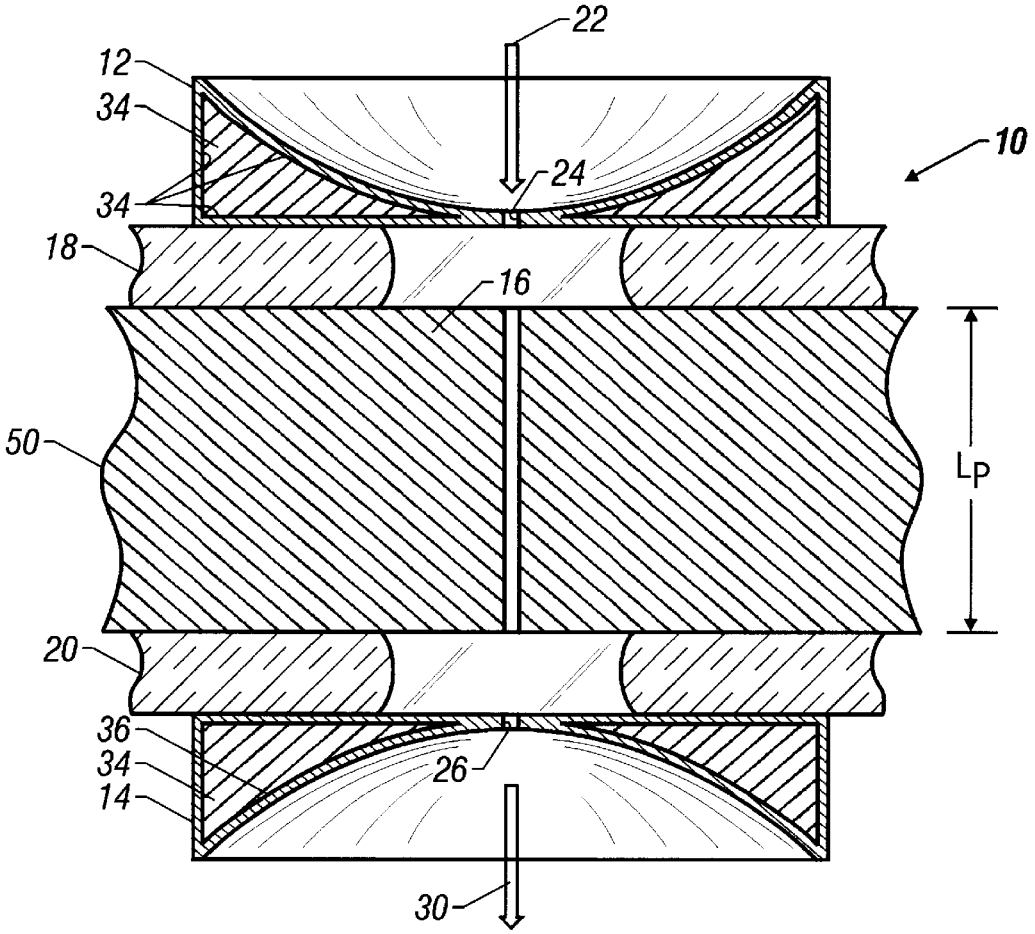
FIG. 5 is a partial cross section through a single pair of metallic poles of one embodiment of a quadrupole mass spectrometer array of the present invention.

Referring now to FIG. 5, a partial cross-section is shown through a single opposing pair of the metallic poles 16 for the mass spectrometer 10, except that the ion source 28 and the ion detector 32 are not shown. As with the other figures, the cross-section of FIG. 5 is not necessarily to scale and is shown only for purposes of illustration. Shown in FIG. 5 are the entrance device 12, including one of the apertures 24, the exit device 14, including one of the apertures 26, two directly opposing poles 16, the entrance spacer 18, and the exit spacer 20. Low dielectric-constant materials are preferably used for the spacers 18, 20 to lower capacitance.

With reference to FIGS. 4 and 5, the poles 16 are preferably non-magnetic, non-reactive, metallic rods, such as gold or titanium. The spacers 18, 20 are insulators, preferably of glass, to isolate the poles 16 during operation of the quadrupole mass spectrometer 10 of the present invention.

The entrance device 12 is important to at least partially isolate the ion filter 29 and the ion source 28 and to channel ions from the ion source into the ion filter 29. By acting as an isolation shield, the entrance device 12 reduces the possibility of detrimental interference between the ion source 28 and the ion filter 29.

The exit device 14 is important to at least partially isolate the ion filter 29 and the ion detector 32 and to channel ions from the ion filter 29 to the ion detector 32. By acting as an isolation shield, the exit device 12 reduces the possibility of detrimental interference between the ion filter 29 and the ion detector 32.

The entrance and exit devices 12, 14 may each be comprised of substantially entirely only dielectric material. As shown in FIG. 5, however, it is preferred that the entrance device 12 and exit device 14 each include a dielectric interior body portion 34, such as a silicon substrate 34, coated with an electrically conductive outer layer 36, preferably a gold/chromium film layer attached to and supported by the body portion 34. Preferably, the electrically conductive outer layer 36 extends into the interior of the apertures 24, 26, as shown in FIG. 5. The electrically conductive outer layer 36 at least partially protects the array of poles 16 during operation of the quadrupole mass spectrometer 10 by dissipating the charge of ions that strike the outer layer 36. The entrance device 12 may have a flat or concave surface for receiving the ion beam 22, and the exit device 14 may have a flat or concave surface for directing the exiting mass-filtered ions 30. As shown in FIGS. 4 and 5, the surfaces are concave. Furthermore, although it is most preferred that the electrically conductive outer layers 36 completely surround the entrance device 12 and exit device 14, as shown in FIG. 5, such complete surrounding is not required. Preferably, however, the conductive outer layer 36 of the entrance device 12 covers at least a portion of, and more preferably substantially all of, the surface of the entrance device 12 facing the ion source 28. Likewise, it is preferred that the conductive layer 32 of the exit device 14 cover at least a portion of, and more preferably substantially all of, the surface of the exit device 14 facing the ion filter 29.

The ion detector 32 is preferably any suitable detector for detecting selected ions of the ion beam 22 in accordance with the invention, such as a Faraday-type ion detector or a single-particle multiplier detector.

With reference primarily to FIG. 4, the ion filter 29 is shown, including the poles 16. The area 52 shown in FIG. 4 is that portion of the ion filter 29 shown in larger scale in FIG. 2. The connecting strips 50 radiate outward from the poles 16 and terminate in electrical connection with one of either bonding pads 44 or bonding pads 46. One of the bonding pads (either 44 or 46), the associated connecting strip 50 and the associated pole 16 are typically manufactured as an integral unit, as described more fully below with the discussion concerning preferred manufacturing methods for making the ion filter 29. Also, the bonding pads 44 and the bonding pads 46 are offset, so that electrical connections may more easily be made to the bonding pads 44, 46. During operation of the mass spectrometer 10, an RF frequency voltage and a DC voltage, as described previously, are applied to the poles 16 via electrical connections made to the bonding pads 44, 46. The specific frequency and magnitude of the RF voltage and the specific magnitude of the DC voltage applied to the poles 16 determine the value of m/z for ions passing through the ion filter 29 to exit with the mass filtered ions 30 for detection. By varying the frequency and/or voltages, the selected m/z for ions passing through the ion filter 29 may be varied. By continuously or periodically varying the RF frequency and voltages over a predetermined range, the mass spectrometer 10 may be used to scan for ions over a wide range of m/z values. The mass spectrometer 10 may be designed for m/z detection in the range of m/z of from about 1 to about 4000. For many applications, however, the range for m/z detection with the mass spectrometer 10 is from an m/z of about 1 to an m/z of about 300.

With continued reference to FIG. 4, the patterned layer of the ion filter is substantially entirely supported by the exit spacer 20, which acts as a common supporting substrate. The exit spacer 20 has an opening 35 through the exit spacer 20. As the ion filter 29 is supported by the exit spacer 20, the opening 35 and the ion filter 29 are aligned so that at least the area 52 of the ion filter, including the poles 16 and portions of the connecting strips 50, are positioned over the opening 35. Therefore, the poles 16 and at least a portion of the connecting strips 50 are suspended from the exit spacer 20 over the opening 35. The opening 35 forms part of a pathway permitting ions from the ion source 28 to travel through the ion filter 29 to the ion detector 32. This pathway includes an entrance aperture 24 through the entrance device 12, an opening 37 through the entrance spacer. 18, the quadrupole channels 17 (shown in FIG. 2) through the array of the poles 16, the opening 35 through the exit spacer 20 and the exit apertures 26 through the exit device 14.

It will be recognized that the relationship between the poles 16 and a common supporting substrate may involve different geometries in the mass spectrometer 10 without departing from the spirit of the invention. For example, the common supporting substrate could include a plurality of openings, rather than just one opening, with a different group of the poles 16 suspended over each of the plurality of openings. Also, the common supporting substrate could be used as an entrance spacer, rather than an exit spacer, with the ion filter supported on the side facing away from the ion source 29, rather than toward the ion source 29, as is shown in FIGS. 4 and 5, and an exit spacer could thus be used that is of similar design to the entrance spacer 18 as shown in FIGS. 4 and 5.

The mass spectrometer 10 may be operated at any convenient RF frequency. Typically, however, the length of the poles 16 (shown as the dimension $L_p$ in FIG. 5) will be short enough to permit operation of the quadrupole mass spectrometer at low RF frequencies, such as frequencies less than about 50 MHz, which is generally preferred. This lower operational frequency allows the voltages $V_0$ and $U_0$ to be maintained at conveniently low values for the desired mass range to reduce the possibility of arcing across closely-spaced parts and to minimize power consumption in the electronics and radiation (varying as the sixth power of frequency). For example, a convenient length, $L_p$, of the poles 16 may range from about 2 mm to about 6 mm, as previously discussed, and may even be selected to be shorter than about 2 mm.

The use of short poles 16 and a Faraday-type ion detector allows operation at higher pressures, often in the millitorr range, wherein the particle's mean free path length may be comparable to instrument dimensions. As will be appreciated, operation at higher pressures allows the use of a smaller, less expensive backing pump to create the required vacuum conditions, rather than using, for example, a larger, higher-speed turbomolecular pump in combination with a backing pump.

The entrance device 12, spacers 18 and 20, bonding pads 44 and 46, and exit device. 14 may have electrically conductive surfaces since they are located near charged-particle beams to produce known and fixed particle energies. As will be appreciated, the materials used to fabricate all the components preferably have coefficients of thermal expansion that are low enough to control distortion caused by operational temperature variations.

As noted previously, the poles 16 may have a hyperbolic shape (to follow the original Mathieu-equation formulation of the quadrupole problem). However, the poles 16 may also have other shapes with negligible loss in mass resolution, such as cylindrical (i.e., with a semicircle or other circle arc section at the terminal ends forming the poles 16). Other shapes may provide easier final fabrication of plating molds (discussed below) for the poles 16 and, possibly, a denser packing of the poles 16.

During operation of the mass spectrometer 10, of a configuration as shown in FIG. 4, portions of the incident ion beam 22 passes through the entrance apertures 24 contained within the entrance device 12. Each of the entrance apertures 24 should correspond to and be aligned with one of the quadrupole channels 17 (shown in FIG. 2) within the array of poles 16, so that the entrance apertures 24 channel ions form the ion source 28 to the ion filter 29. Ions from the ion beam 22 that pass through the apertures 24 then travel through the array of the poles 16 of the ion filter 29. Ions exiting the ion filter 29 then depart through the exit apertures 26 contained within the exit device 14 as the mass-filtered ions 30 to be detected by the ion detector 32. Each of the exit apertures 26 should correspond to and be aligned with one of the quadrupole channels 17 (shown in FIG. 2) within the array of poles 16, so that the entrance apertures 24 channel ions exiting the ion filter 29 to the ion detector 32.

Detection sensitivity lost in miniaturization may be at least partially overcome by the use of numerous quadrupoles working in parallel as shown in FIGS. 4 and 5. As will be appreciated, miniaturization tends to reduce detection sensitivity because fewer particles can be admitted into the reduced entrance apertures 24 of the mass spectrometer 10. Thus, the basic pattern, described above and shown in FIGS. 2–5, can be repeated 1 to 10,000 times or more (depending on the desired results) to form a desired array of poles 16. Moreover, the poles 16 may be wired to all work in parallel, or different parts of the array of the poles 16 can be tuned to different mass ranges. As will be appreciated, variable control over operations of the spectrometer 10 may be useful when monitoring, for example, in an atmosphere or plasma, a transient phenomena, or a spatially-variable phenomena.

Figure 6:
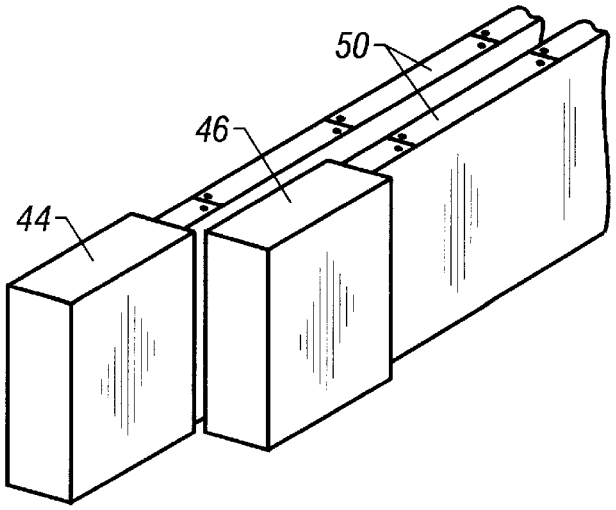
FIG. 6 is a partial perspective view of a bonding pad configuration with connecting strips attached to alternate poles of one embodiment of a quadrupole mass spectrometer of the present invention.
Figure 7:
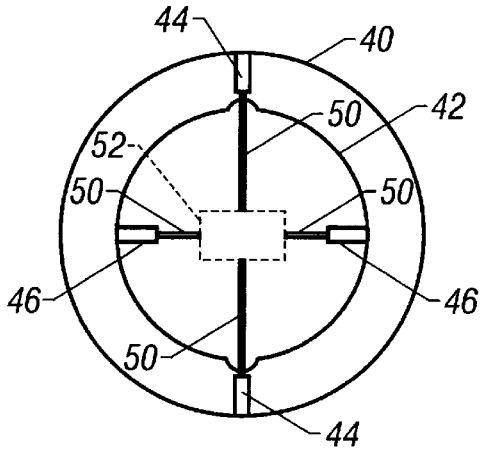
FIG. 7 is a top view of one embodiment of a bonding configuration for making electrical connection to poles of an ion filter of the present invention.

Referring now primarily to FIGS. 4, 6 and 7, a preferred manner for making electrical connections to the poles will now be described. FIG. 6 illustrates a perspective view of one type of bonding configuration and FIG. 7 shows a single quadrupole device for illustrating bonding configurations and electrical connections. The metal connecting strips 50 are attached between the bonding pads 44, 46 and the poles 16 to support the poles 16 of the ion filter 29 suspended over the opening 35 through the exit spacer 20 and to electrically connect the poles 16 to an RF generator (not shown). The bonding pads 44, 46 are each at a terminal end of the integral piece opposite the poles 16. The bonding pads 44, 46 provide additional structural strength for each connected pole 16 and for providing a site for wire bonding at the top of these structures as a secondary method of electrical connectivity.

As shown in FIGS. 6 and 7, the array of the present invention may have parallel wiring in an easy-access configuration. For example, dual tracks, a Track A 40 and a Track B 42, may be used with the dual bonding pads 44, 46 (one for each track) and the metal connecting strips 50 to electrically connect the bonding pads 44, 46 with the poles 16. The metal connecting strips 50 are connected to alternate positive (+) and negative (−) poles 16 of the quadrupole array. Outer metal Track A 40 and inner Track B 42 provide parallel access to the positive (+) and negative (−) poles 16, respectively. For example, all the positive (+) poles 16 may be connected to Track A 40, and all the negative (−) poles 16 may be connected to Track B 42, or vice versa.

The dual bonding pads 44, 46, one for Track A 40 and one for Track B 42, have a sufficient bonding surface, such as approximately 1 mm by 3 mm. The bonding pad 44 of Track A 40 is preferably at least approximately 0.5 mm from Track B 42 so that there is sufficient clearance between Track A 40 and Track B 42. Electrical connectivity is realized by wire bonding, pressure contacting, or electroplating the structure from a previously-patterned substrate, such as exit spacer 20 of FIG. 4. The conducting poles 16, the connecting strips 50 and the bonding pads 44, 46, along with the dual tracks 40, 42 form the ion filter 29 for this embodiment. The exit spacer 20 (as shown in FIG. 4) preferably includes an electrically conductive bonding pattern 33, which is a patterned electrically conductive film that has a pattern that matches and corresponds with the pattern of the connecting strips 50 and the bonding pads 44, 46. The bonding pattern 33 enhances the ability to securely bond the ion filter 29 to the exit spacer 20. Furthermore, bonding of the connecting strips 50 and bonding pads 44, 46 securely to the exit spacer 20 maintains the poles 16 with the desired orientation with the poles suspended over the opening 35.

The present invention recognizes that several fabrication methods may be employed to produce the ion filter 29 of the present invention. It is important, however, that the manufacture method be such that the poles 16, as manufactured, have alignment and relative positioning for final use in a quadrupole mass spectrometer. This is typically accomplished by forming the patterned layer of the ion filter 29 so that it is all substantially supported by a common supporting substrate, such as the exit spacer 20.

One such method of the present invention for making the ion filter 29 quadrupole array includes the simultaneous fabrication of the poles 16, such as by simultaneously forming the poles 16, and typically also simultaneously forming the remainder of the patterned layer of the ion filter 29, in a mold by filling the pattern of the mold with electrically conductive material. In a preferred embodiment, the mold includes the pattern for all of the poles 16, the connecting strips 50 and the bonding pads 44, 46, which are all then fabricated simultaneously by filling the mold. As may be appreciated, the mold may be produced in a separate process or included as a step(s) in making the ion filter 29 of the present invention. Although other methods may be acceptable, one preferred means of creating the mold is through Lithographie-Galvanoformung-Abformung (LIGA) manufacture, discussed in more detail below. Similarly, any acceptable method may be used to fill the mold with electrically conductive material, such as, for example, by electroplating, chemical vapor deposition, physical vapor deposition, or loading voids in the mold with nanoparticles of the desired material. LIGA manufacture is particularly useful for poles 16 having lengths in a range of from about 0.5 mm to about 6 mm, and preferably of from about 0.5 mm to about 4 mm.

Another method of making the array of the poles 16 involves precise selective removal of portions of a work piece, that is initially a single solid sheet of electrically conductive material, to obtain the desired patterned layer for the ion filter 29. It is preferred that all of the poles 16, the connecting strips 50 and the bonding pads 44, 46 be manufactured from the same work piece and that the final patterning be done only when the single work piece is supported by a common substrate, such as the exit spacer 20. The selective removal may be any suitable technique. In this regard, Electrical Discharge Machining (EDM), discussed in detail below, may be employed to selectively remove material from the work piece and thereby obtain acceptable tolerances for poles 16. EDM manufacture is particularly preferred for manufacturing poles having a length of at least about 4 mm.

As will be appreciated, the use of the LIGA and EDM fabrication methods facilitates the production of poles 16 of a quadrupole array having the desired relative positioning of the poles 16 in a high density array. In this regard, the density and small size of the array is advantageously achieved by forming all of the poles 16 so that, as manufactured, the patterned layer, including the poles 16, the connecting strips 50 and the bonding pads 44, 46, is supported by a single substrate (e.g., the exit spacer 20). It should, however, be recognized that, although it is preferred that the method of the invention may be used to fabricate the entire patterned layer of an ion filter 29, the invention is not so limited. The method could be used, for example, to manufacture only an array of poles 16 in alignment, with electrical connections to the poles 16 being made other than through the connecting strips 50 and bonding pads 44, 46.

With EDM-based manufacture, all of the poles 16 and other portions of the patterned layer of the ion filter 29 are formed by selective removal of material from a single piece of electrically conductive material that has been first bonded to and supported on a common substrate (e.g., exit spacer 20). In the case of LIGA-based manufacture, the poles 16 and portions of the patterned layer of the ion filter 29 are formed in a single operation by filling a mold, with the mold being located over a common supporting substrate (e.g., exit spacer 20) so that the patterned layer of the ion filter 29 will be supported by the common supporting substrate. In this manner, proper alignment of the poles 16 is established concurrently with manufacture of the poles 16. By manufacturing the poles 16 so that, as manufactured, they are supported by a common supporting substrate, problems associated with positioning and aligning preformed rods, as is encountered with manufacture of conventional quadrupole devices, may be avoided. Rather, with the present invention, positioning and alignment of the poles 16 are accomplished during the same process operation in which the poles 16 are formed, considerably simplifying manufacture of the ion filter 29 by eliminating steps involving positioning and aligning loose, preformed rods.

METHOD OF FABRICATION USING A MOLD

Figure 8:
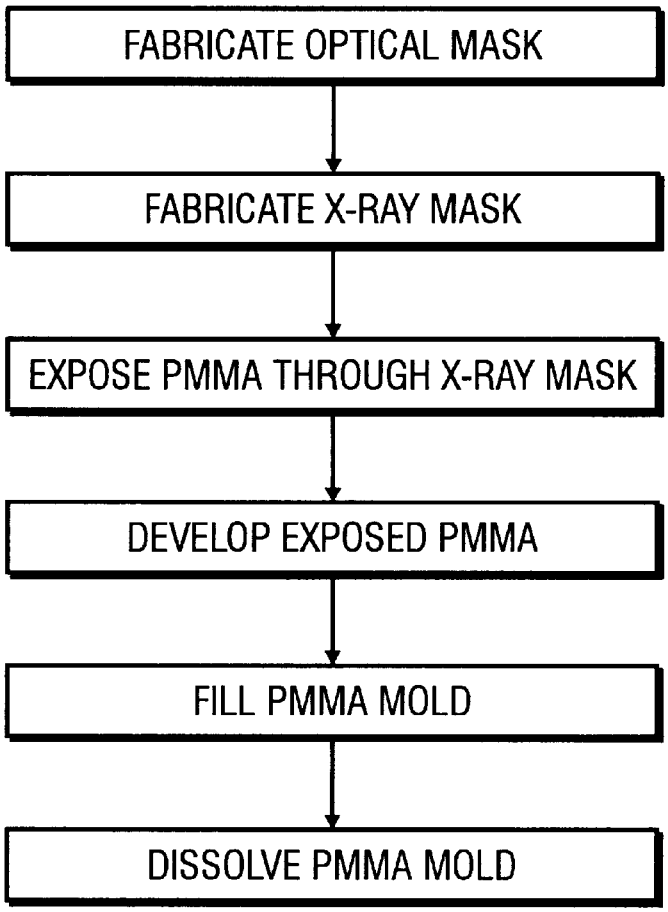
FIG. 8 is a flow diagram illustrating one embodiment of a LIGA-based process of the present invention for making an ion filter for use in a quadrupole mass spectrometer.

The manufacturing method of the present invention will now be exemplified with a description of one embodiment of the method involving formation of an array of poles, and other portions of the patterned layer of the ion filter, by filling a mold. Preparation of the mold by the LIGA technique is also described, although it will be appreciated that the mold could be made by any suitable technique or could be acquired from an external source, such as an outside specialty manufacturer. FIG. 8 shows a process flow diagram illustrating one embodiment of the LIGA-based fabrication process of the present invention. It will be appreciated that the order of the steps is intended to be only illustrative in nature.

The LIGA method is employed in the present invention to manufacture a mold, which is also sometimes also referred to as a template. The mold may be made of any suitable material, but is typically a polymeric material, such as polymethyl methacrylate (PMMA) or a polyimide. A preferred material for the mold is PMMA. The discussion here will, therefore, be with reference to PMMA as an example of the mold material. The same principles apply to other mold materials. The molds are filled with an electrically conductive material to form the patterned layer of the ion filter, including an array of the poles. Because electroplating is a preferred method for filling the molds, the process is discussed with reference to electroplating by way of example. The same principles apply, however, to other methods for filling the mold.

To manufacture a quadrupole mass spectrometer with the ion filter, other components such as entrance and exit devices and spacers are manufactured and then modularly assembled with the ion filter. The resulting quadrupole mass spectrometer is typically 1/50th, or smaller, of the mass and volume of present commercial quadrupole mass spectrometer devices. In that regard, the quadrupole mass spectrometer 10, as shown in FIGS. 4 and 5, may have a weight of smaller than about 7 grams and may occupy a total volume of smaller than about 2 cubic centimeters. Detection sensitivity lost in miniaturization may be at least partially overcome by fabricating the ion filter with a plurality of quadrupoles working in parallel, thereby increasing the area available for ion travel. For example, the ion filter of the present invention could include 10, 100 or even 10,000 or more quadrupoles. Although it will be appreciated that as the number of quadrupoles becomes very large, the size of the device will necessarily increase.

Using LIGA-based techniques, fabrication of the patterned layer of the ion filter is accomplished, for example, through electron-beam lithography (to manufacture repetitive gold LIGA X-ray masks using intermediate steps of contact-printing and gold-plating) followed by X-ray exposure of the PMMA in a synchrotron light source. The exposed PMMA is chemically developed away, the pattern of void spaces are filled by electroplating with electrically conductive material (gold or titanium is preferred), and exit and entrance spacers and entrance and exit devices having apertures are provided for assembly. After these components are aligned, assembled, and bonded together, an RF generator may be connected (e.g., through wire bonding techniques) and an ion source and ion detector provided to complete fabrication of a mass spectrometer.

LIGA-based processing is suitable to this manufacture because it is capable of producing high dimensional accuracy which allows the quadrupole array (e.g., poles) to be electroplated to a close tolerance, preferably to within a 0.1% dimensional tolerance. The LIGA method achieves this accuracy at least in part by using computer-aided mask manufacture to create masks used in fabricating the final template. To further improve the quality of the produced quadrupole array, advanced bonding techniques, such as anodic, diffusion, eutectic, or ultrasonic bonding, can be used to create contamination-free, corrosion- and temperature-resistant bonds without altering the dimensions of poles, connecting strips, and bonding pads.

One Embodiment of LIGA-Based Fabrication:

With reference to FIG. 8 showing the sequence of processing steps and FIG. 4 showing various components of the quadrupole mass spectrometer 10, one embodiment of LIGA-based fabrication of the patterned layer of the ion filter 29 is described.

(a) Fabricate Optical Mask:

In this step, an optical photomask is fabricated for subsequent use in the fabrication of an X-ray mask. A standard electron-beam lithography apparatus is used to etch the "footprint" or pattern of the ion filter (i.e., poles 16, connecting strips 50, and bonding pads 44, 46) in a resist material coating a quartz substrate on which a UV opaque material, typically chromium, has been previously deposited. In this regard, the electron beam can be precisely controlled to an accuracy of about 1 nm in 1 cm. After exposure to the electron beam, the undesired resist material is developed away, and the entire mask is then placed in an etchant bath to remove the chromium film from the exposed areas. The remaining resist is then removed leaving the previously-protected chromium pattern to be used as an optical mask for further lithography.

(b) Fabricate X-Ray Mask:

The optical mask of step (a) is next used to fabricate an X-ray mask (to be used in the subsequent exposures in the synchrotron light source, see (c) below). The optical mask of step (a) is laid over a plate consisting of a 50 micron layer of photoresist coated over a 300 angstrom layer of gold, itself on a 50 angstrom layer of chromium, all supported on a silicon substrate. The assembly is then exposed to collimated ultraviolet (UV) radiation which replicates the pattern of (a) by passing through the quartz-only portions of the optical mask. Next, the undesired photoresist is developed away, and gold is then plated into these developed regions. As can be appreciated, this process creates a four-layer mask consisting of a patterned 50 micron gold layer on a 300 angstrom gold layer, itself on a 50 angstrom chromium layer, all on the silicon substrate.

(c) Expose PMMA Through X-Ray Mask:

A PMMA sheet, having a thickness slightly greater than the final desired thickness of the patterned layer of the ion filter 29 is then exposed through the X-ray mask of step (b) to synchrotron X-ray radiation. The excess thickness is provided to accommodate lapping of the final structure, as discussed below. A synchrotron light source is used because it provides a collimated, intense beam of X-rays. These X-rays irradiate the PMMA sheet through the X-ray mask at the thin-gold locations. Because the X-rays are blocked by the thick-gold areas of the mask, the pattern of the ion filter is replicated in the PMMA sheet. A single X-ray mask may be used to pattern numerous PMMA sheets.

(d) Develop Exposed PMMA:

The PMMA sheet of step (c) is then placed in a suitable mixture of solvents, such as methyl isobutyl ketone (MIBK), to dissolve the portion of the PMMA sheet exposed to X-rays in step (c). The solvent mixture is chosen so as not to dissolve or otherwise deteriorate portions of the PMMA sheet not exposed to X-rays. The resulting patterned PMMA sheet provides a template of the ion filter that can now be used as a mold that can be filled with electrically conductive material to form the patterned layer of the ion filter 29, including the array of the poles 16 for the quadrupole array of the present invention. The process up to this point has been involved with making the mold. It should be recognized, however, that the mold could be made by any suitable technique or could be purchased in a premanufactured state from an outside source.

(e) Fill PMMA Mold:

Using standard electroplating methods, the PMMA mold of step (d) may now be filled with a selected electrically conductive material (e.g., gold or titanium) to form the quadrupole array. To facilitate electroplating and further fabrication of the quadrupole mass spectrometer of the present invention, the PMMA mold may be placed on a electrically conductive base on a common supporting substrate (e.g., bonding pattern 33 on exit spacer 20) that will form part of the finally assembled mass spectrometer. Because the exit spacer 20 is preferably fabricated from a electrically non-conductive material (e.g., ceramic or other dielectric), the electrically conductive bonding pattern 33 is bonded to the exit spacer 20 prior to placing the PMMA mold on the exit spacer 20, typically by standard thin film or thick film deposition techniques. It will be appreciated that at this point in the manufacture process, the exit spacer 20 will not include the opening 35, so that there will be a solid surface to electroplate against in the area that the opening 35 will eventually occupy.

A typical way to provide the bonding pattern 33 on the exit spacer 20 is to initially deposit a continuous film of electrically conductive material (e.g., gold) on the surface of the exit spacer 20 (i.e., the ceramic material is metallized). The pattern of the ion filter 29 is then lithographically imprinted in this electrically conductive film, and the exit spacer 20, with the lithographically imprinted film, is placed in an etchant bath to selectively remove the electrically conductive film from the exposed areas, thereby forming the electrically conductive bonding pattern 33. In this manner, the bonding pattern 33 is produced on, and bonded to, exit spacer 20. The PMMA mold is now located on the exit spacer 20 so that the bonding pattern 33 is aligned with the pattern for the ion filter 29 in the PMMA mold. The PMMA mold is filled with the appropriate electrically conductive material (e.g., gold or titanium) by electroplating to the bonding pattern 33 that is exposed through the PMMA mold. The final electroplated structure is lapped (e.g., abrasive lapping with a fine-diameter slurry) to provide a flat planar surface having a desired surface finish for subsequent processing and to establish the desired final thickness of the patterned layer of the ion filter 29, which is equal to the desired final length of the poles 16.

(f) Dissolve PMMA Mold:

After the filled PMMA mold has been lapped, the remaining PMMA of the mold is then dissolved in a solvent, such as methylene chloride, leaving a free-standing structure of the ion filter 29 (including the array of poles 16, the connecting strips 50 and the bonding pads 44, 46) bonded to the corresponding bonding pattern 33 and supported by the exit spacer 20. Also, as will be appreciated, the mold may be removed by techniques other than dissolution in a solvent. For example, the material of the mold could be removed by laser ablation. The exit spacer 20 may be machined to create the opening 35 before or after the mold is removed. As will be appreciated, the opening 35 may be produced by employing various machining methods. A preferred technique is ultrasonic machining. For example, ultrasonic impact drilling may be used which involves placing an abrasive slurry in contact with exit spacer 20 and then using a tool, having the shape of the desired opening 35, to rapidly (e.g., reciprocating vibrations at 15 to 30 kHz or higher) and forcefully agitate the fine abrasive materials in the slurry, thereby removing material of the exit spacer 20 to form the opening 35.

The ion filter 29 may now be assembled with other components to make the quadrupole mass spectrometer 10. For example, the entrance spacer 18, typically of glass, may be placed on the exposed-and-lapped surface of the ion filter 29, and the entrance device 12 then placed above the entrance spacer 18. The exit device 14 may then be bonded or clamped to the underside of the exit spacer 20. As will be appreciated, alignment of these components may be facilitated through the use of fiducial marks. The entire assembly may then be bonded in place using methods including, for example, the use of adhesives (of low vapor pressure, so as not to cause contamination), anodic bonding, thermal compression bonding, diffusion bonding, glass-to-metal seals, gold eutectic solder, or constraining the assembly in place through non-deforming mechanical clamping The ion source 28 may then be coupled to the entrance device 12, and the ion detector 32 connected to the exit device 14, and an RF generator may be connected to the bonding pads 44, 46 to make the device functional.

It should be recognized that in the broadest sense, the manufacture method of the present invention involving the use of a mold to form the pattern of the poles 16 need not include all of the steps described with reference to FIG. 8. Rather, it is sufficient that a mold be used to form the pattern so that the poles 16, as they are formed in the mold, have relative positioning and alignment for use in a quadrupole mass spectrometer.

METHOD OF FABRICATION USING EDM TECHNIQUES

Figure 9:
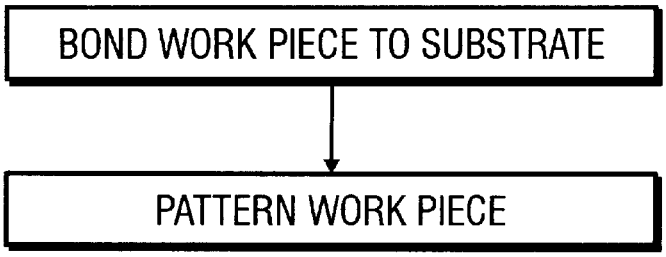
FIG. 9 is a flow diagram illustrating one embodiment of an EDM-based process of the present invention for making an ion filter for use in a quadrupole mass spectrometer.

FIG. 9 shows a process flow diagram illustrating one embodiment of the Electrical Discharge Machining (EDM) based process of the present invention. EDM is a machining process that selectively removes metallic material from a work piece by spark erosion. Unlike conventional machining, which mechanically shears tiny strips from the workpiece, EDM uses alternating current (AC) or direct current (DC) from a special generator to melt and vaporize conductive material away from the workpiece. Cooling and cleaning is usually provided by pumping deionized water through the cutting region. In a preferred embodiment, the present invention includes a small diameter (e.g., 0.001 inch) alloy wire electrode that is driven by machines with accurate computer-controlled drives in the x, y and z axes. The machines are computer programmed to give the desired final geometry and dimensions of the workpiece.

One Embodiment of EDM-Based Fabrication:

With reference to FIG. 9 showing the sequence of processing steps and to FIG. 4 showing various components of the quadrupole mass spectrometer 10, one embodiment of EDM fabrication of the patterned layer of the ion filter 29 is described.

(a) Bond Work Piece to Substrate:

A supporting substrate (e.g., exit spacer 20) is provided having the bonding pattern 33. To the bonding pattern 33 is bonded a single work piece, in the form of a sheet of electrically conductive metal (e.g., gold or titanium). The sheet preferably has a thickness that is substantially equal to the desired thickness for the final patterned layer of the ion filter 29, and therefore also substantially equal to the desired final length of the poles 16. The bonding pattern 33 may have been formed on the exit spacer 20 as previously described in the discussion concerning LIGA-based manufacture. Bonding of the work piece to the bonding pattern 33 on the substrate may be accomplished in any suitable manner. A preferred manner of bonding is by the use of solder placed between the bonding pattern 33 and the work piece. Also, it is preferred that at the time the work piece is bonded to the exit spacer 20, the exit spacer already has the opening 35 therethough. It is, however, possible to make the opening 35 after the work piece has been bonded to the exit spacer 20, if desired. Also, the opening 35 may be made before or after the bonding pattern 33 has been formed on the exit spacer 20.

(b) Pattern Work Piece:

After the work piece has been bonded to the substrate, wire EDM is used to selectively remove material from the work piece to form the patterned layer of the ion filter 29, including the poles 16, connecting strips 50 and bonding pads 44 and 46. The geometry and accuracy of the selections removed are controlled by the software and accurate x, y, and z directional drives and is preferably to within a 0.1% dimensional tolerance. As will be appreciated, the metallic work piece may have been at least partially patterned (through EDM or other methods) prior to being bonded in step (a) to the bonding surface on exit spacer 20. For example, the bonding pads 44 and 46 and the connecting strips 50 may be at least partially patterned prior to bonding to the exit spacer 20, simplifying the patterning of the work piece on the substrate. It is important, however, that the final division of the work piece into the separate integral pieces for each of the poles 16 not occur until after the work piece has been bonded to the exit spacer 20. In this way, the poles 16 are formed with the proper positioning and alignment for use in a quadrupole mass spectrometer, with the positioning and alignment being retained by the bond to the exit spacer 20.

It should be appreciated that in its broadest sense, the EDM processing of the present invention does not require the first step shown in FIG. 9, i.e., the bonding step. The substrate could be acquired from an outside supplier with the work piece already bonded to the substrate. It is sufficient that selective removal of material from the work piece bonded to the substrate occur in a manner such that the poles 16, as they are formed, have the relative positioning and alignment for use in a quadrupole mass spectrometer.

After the work piece has been patterned into the patterned layer of the ion filter 29, then the ion filter 29 may be assembled, along with other components, into the mass spectrometer 10, in a manner as previously described.

Applications

As will be appreciated, the use of the above discussed LIGA-based and EDM-based fabrication processes facilitate the production of accurate, miniature quadrupole mass spectrometers with reduced complexity of manufacture relative to conventional manufacture of quadrupole mass spectrometers. It is anticipated that the reduced cost and advantageous size of the quadrupole mass spectrometer of the present invention will have many commercial applications. In this regard, the miniature quadrupole mass spectrometer of the present invention may be used for process control, personnel safety, and pollution monitoring. Also, the small size of the present invention allows small sensors containing the miniature quadrupole mass spectrometer to be manufactured. Commercial applications of the small sensors may include distributing the sensors throughout manufacturing plants, in public areas (such as buildings and subway systems), within plasma chambers (chip manufacturers), in earth-orbiting space stations, in long-duration human flight missions, for planetary aeronomy and planetary-surface studies, etc. Other commercial applications of the present invention may include automotive exhaust monitoring, home fire/radon/CO monitoring, personnel environmental monitoring, smokestack monitoring, and down-hole monitoring.

Also, because of the small size of the device, a high vacuum may not be required in some applications. This is because the requirement of small particle mean free path relative to the (small) spacing of the poles, as described above, can now be met with the present invention at a higher ambient pressure. This obviates the need for sophisticated pumping and can place devices of the present invention into the realm of operation of, for example, micromachined peristaltic pumps. Use at the higher pressures would require a pressure-resistant electron emitter (such as a field ionizer) to ionize the neutral species and a Faraday cup as the ion detector.

Furthermore, although the present invention has been described primarily in reference to the quadrupole mass spectrometer, the invention, in its broadest aspects is not so limited. Rather, one important aspect of the present invention relates to the ion filter described herein and methods for making the ion filter.

Moreover, while the invention has been described in combination with specific embodiments thereof, it is evident that many alternatives, modifications, and variations will be apparent to those skilled in the art in light of the foregoing description. Specifically, it should be understood that the order of the fabrication and assembly of the present invention may be altered from that given as an illustration. Further, it should be understood that a fabrication step may be omitted (e.g., by purchasing a prefabricated component) and still be within the spirit of the present invention. Accordingly, it is intended to embrace all such alternatives, modifications, and variations as fall within the spirit and broad scope of the appended claims.

What is claimed is:

1. A method for fabricating a pole array for use in a quadrupole mass spectrometer, the method comprising:

(a) plating a bonding pad onto a substrate;

(b) bonding the substrate to form a workpiece;

(c) selectively removing material from the workpiece using wire electrical discharge machining to pattern the pole array into the workpiece.

2. The method as set forth in claim 1, wherein the bonding pad is an electrically conductive metal.

3. The method as set forth in claim 2, wherein the electrically conductive metal is at least one of: (a) gold; and, (b) titanium.

4. The method as set forth in claim 1, wherein step (b) further comprises:

bonding a metal onto the bonding pad.

5. The method as set forth in claim 4, wherein the metal is at least one of: (a) gold; and, (b) titanium.

6. The method as set forth in claim 5, wherein the metal is anodically bonded onto the bonding pad.

7. The method as set forth in claim 1, wherein the pole array comprises at least four poles, and the length of each of the poles at least approximately 3 millimeters.

8. The method as set forth in claim 7, wherein each pole is made of a non-magnetic, metallic material.

9. The method as set forth in claim 8, wherein the non-magnetic, metallic material is at least one of: (a) gold; and, (b) titanium.

10. The method as set forth in claim 7, wherein each pole has a hyperbolic shape defined by an original Mathieu-equation quadrupole formulation.

11. The method as set forth in claim 7, wherein each pole has a cylindrical shape.

12. The method as set forth in claim 7, wherein each pole has any shape suitable with negligible loss in mass resolution.

13. The method as set forth in claim 7, wherein each pole has an appropriate shape and length such that they operate at suitably low RF frequencies.

14. The method as set forth in claim 13, wherein the length of each pole is in a range sufficient to allow operation of the quadrupole mass spectrometer at frequencies of less than 50 MHz.

15. The method as set forth in claim 1, wherein the substrate is a ceramic material.

16. The method as set forth in claim 1, wherein the bonding pad of step (a) further comprises:

a plurality of bonding pads; and, a plurality of connecting strips wherein each of the connecting strips is located between a respective bonding pad and one of the poles in the pole array, and wherein each of the bonding pads provides additional structural strength, and a site for wire bonding to provide a secondary method of electrical connectivity.

17. The method as set forth in claim 16, wherein the bonding pads have an alternating positive and negative pole arrangement.

18. The method as set forth in claim 17, wherein the alternating positive and negative pole arrangement is defined by an outer conductive track and an inner conductive track, wherein the tracks provide parallel access to positive and negative poles, respectively.

19. The method as set forth in claim 18, wherein the positive poles are connected to the outer track and the negative poles are connected to the inner track.

20. The method as set forth in claim 18, wherein the outer track is 0.5 millimeters from the inner track to allow sufficient clearance between the inner and the outer track.

21. The method as set forth in claim 16, wherein the bonding pads are rectangular shaped with dimensions of 1 millimeter long by 3 millimeters wide.

22. A method for fabricating a quadrupole mass spectrometer, the method comprising:

(a) plating a bonding pad onto a substrate;

(b) bonding the substrate to form a workpiece;

(c) cutting the workpiece using wire electrical discharge machining to pattern a pole array into the workpiece and form a pole array; and, (d) attaching spacers, an entrance aperture and an exit aperture to the pole array.

23. The method as set forth in claim 22, wherein the bonding pad is an electrically conductive metal.

24. The method as set forth in claim 23, wherein the electrically conductive metal is at least one of: (a) gold; and, (b) titanium.

25. The method as set forth in claim 22, wherein step (b) further comprises:

bonding a metal onto the bonding pad.

26. The method as set forth in claim 25, wherein the metal is at least one of: (a) gold; and, (b) titanium.

27. The method as set forth in claim 26, wherein the metal is anodically bonded onto the bonding pad.

28. The method as set forth in claim 22, wherein the pole array comprises at least four poles, and the length of each of the poles is greater than approximately 3 millimeters.

29. The method as set forth in claim 28, wherein each pole is made of a non-magnetic, metallic material.

30. The method as set forth in claim 29, wherein the non-magnetic, metallic material is at least one of: (a) gold; and, (b) titanium.

31. The method as set forth in claim 28, wherein each pole has a hyperbolic shape defined by an original Mathieu-equation quadrupole formulation.

32. The method as set forth in claim 31, wherein the spacers are glass.

33. The method as set forth in claim 28, wherein each pole has a cylindrical shape.

34. The method as set forth in claim 28, wherein each pole has any shape suitable with negligible loss in mass resolution.

35. The method as set forth in claim 28, wherein each pole has an appropriate shape and length such that they operate at suitably low RF frequencies.

36. The method as set forth in claim 35, wherein the length of each pole is in a range sufficient to allow operation of the quadrupole mass spectrometer at frequencies of less than 50 MHz.

37. The method as set forth in claim 22, wherein the substrate is a ceramic material.

38. The method as set forth in claim 22, wherein the spacers are diffusion-bonded to each pole in the pole array.

39. The method as set forth in claim 38, wherein the spacers are anodically bonded.

40. The method as set forth in claim 22, wherein the spacers are made of an insulating material.

41. The method as set forth in claim 22, wherein the bonding pad of step (a) further comprises:

a plurality of bonding pads; and, a plurality of connecting strips wherein each of the connecting strips is located between a respective bonding pad and one of the poles in the pole array, and wherein each of the bonding pads provides additional structural strength, and a site for wire bonding to provide a secondary method of electrical connectivity.

42. The method as set forth in claim 41, wherein the bonding pads have an alternating positive and negative pole arrangement.

43. The method as set forth in claim 42, wherein the alternating positive and negative pole arrangement is defined by an outer conductive track and an inner conductive track, wherein the tracks provide parallel access to positive and negative poles, respectively.

44. The method as set forth in claim 43, wherein the positive poles are connected to the outer track and the negative poles are connected to the inner track.

45. The method as set forth in claim 43, wherein the outer track is 0.5 millimeters from the inner track to allow sufficient clearance between the inner and the outer track.

46. The method as set forth in claim 41, wherein the bonding pads are rectangular shaped with dimensions of 1 millimeter long by 3 millimeters wide.

47. A pole array for use in a quadrupole mass spectrometer, fabricated by a method comprising:

(a) plating a bonding pad onto a substrate;

(b) bonding the substrate to form a workpiece;

(c) selectively removing material from the workpiece using wire electrical discharge machining to pattern the pole array into the workpiece.

48. The method as set forth in claim 47, wherein the bonding pad is an electrically conductive metal.

49. The method as set forth in claim 48, wherein the electrically conductive metal is at least one of: (a) gold; and, (b) titanium.

50. The method as set forth in claim 47, wherein step (b) further comprises:

bonding a metal onto the bonding pad.

51. The method as set forth in claim 50, wherein the metal is at least one of: (a) gold; and, (b) titanium.

52. The method as set forth in claim 51, wherein the metal is anodically bonded onto the bonding pad.

53. The method as set forth in claim 47, wherein the pole array comprises at least four poles, and the length of each of the poles at least approximately 3 millimeters.

54. The method as set forth in claim 53, wherein each pole is made of a non-magnetic, metallic material.

55. The method as set forth in claim 54, wherein the non-magnetic, metallic material is at least one of: (a) gold; and, (b) titanium.

56. The method as set forth in claim 53, wherein each pole has a hyperbolic shape defined by an original Mathieu-equation quadrupole formulation.

57. The method as set forth in claim 53, wherein each pole has a cylindrical shape.

58. The method as set forth in claim 53, wherein each pole has any shape suitable with negligible loss in mass resolution.

59. The method as set forth in claim 53, wherein each pole has an appropriate shape and length such that they operate at suitably low RF frequencies.

60. The method as set forth in claim 59, wherein the length of each pole is in a range sufficient to allow operation of the quadrupole mass spectrometer at frequencies of less than 50 MHz.

61. The method as set forth in claim 47, wherein the substrate is a ceramic material.

62. The method as set forth in claim 47, wherein the bonding pad of step (a) further comprises:

a plurality of bonding pads; and, a plurality of connecting strips wherein each of the connecting strips is located between a respective bonding pad and one of the poles in the pole array, and wherein each of the bonding pads provides additional structural strength, and a site for wire bonding to provide a secondary method of electrical connectivity.

63. The method as set forth in claim 62, wherein the bonding pads have an alternating positive and negative pole arrangement.

64. The method as set forth in claim 63, wherein the alternating positive and negative pole arrangement is defined by an outer conductive track and an inner conductive track, wherein the tracks provide parallel access to positive and negative poles, respectively.

65. The method as set forth in claim 64, wherein the positive poles are connected to the outer track and the negative poles are connected to the inner track.

66. The method as set forth in claim 64, wherein the outer track is 0.5 millimeters from the inner track to allow sufficient clearance between the inner and the outer track.

67. The method as set forth in claim 62, wherein the bonding pads are rectangular shaped with dimensions of 1 millimeter long by 3 millimeters wide.

68. A quadrupole mass spectrometer, fabricated by a method comprising:

(a) plating a bonding pad onto a substrate;

(b) bonding the substrate to form a workpiece;

(c) cutting the workpiece using wire electrical discharge machining to pattern a pole array into the workpiece and form a pole array; and, (d) attaching spacers, an entrance aperture and an exit aperture to the pole array.

69. The method as set forth in claim 68, wherein the bonding pad is an electrically conductive metal.

70. The method as set forth in claim 69, wherein the electrically conductive metal is at least one of: (a) gold; and, (b) titanium.

71. The method as set forth in claim 68, wherein step (b) further comprises:

bonding a metal onto the bonding pad.

72. The method as set forth in claim 71, wherein the metal is at least one of: (a) gold; and, (b) titanium.

73. The method as set forth in claim 72, wherein the metal is anodically bonded onto the bonding pad.

74. The method as set forth in claim 68, wherein the pole array comprises at least four poles, and the length of each of the poles is greater than approximately 3 millimeters.

75. The method as set forth in claim 74, wherein each pole is made of a non-magnetic, metallic material.

76. The method as set forth in claim 75, wherein the non-magnetic, metallic material is at least one of: (a) gold; and, (b) titanium.

77. The method as set forth in claim 74, wherein each pole has a hyperbolic shape defined by an original Mathieu-equation quadrupole formulation.

78. The method as set forth in claim 77, wherein the spacers are glass.

79. The method as set forth in claim 74, wherein each pole has a cylindrical shape.

80. The method as set forth in claim 74, wherein each pole has any shape suitable with negligible loss in mass resolution.

81. The method as set forth in claim 74, wherein each pole has an appropriate shape and length such that they operate at suitably low RF frequencies.

82. The method as set forth in claim 81, wherein the length of each pole is in a range sufficient to allow operation of the quadrupole mass spectrometer at frequencies of less than 50 MHz.

83. The method as set forth in claim 68, wherein the substrate is a ceramic material.

84. The method as set forth in claim 68, wherein the spacers are diffusion-bonded to each pole in the pole array.

85. The method as set forth in claim 84, wherein the spacers are anodically bonded.

86. The method as set forth in claim 68, wherein the spacers are made of an insulating material.

87. The method as set forth in claim 68, wherein the bonding pad of step (a) further comprises:

a plurality of bonding pads; and, a plurality of connecting strips wherein each of the connecting strips is located between a respective bonding pad and one of the poles in the pole array, and wherein each of the bonding pads provides additional structural strength, and a site for wire bonding to provide a secondary method of electrical connectivity.

88. The method as set forth in claim 87, wherein the bonding pads have an alternating positive and negative pole arrangement.

89. The method as set forth in claim 88, wherein the alternating positive and negative pole arrangement is defined by an outer conductive track and an inner conductive track, wherein the tracks provide parallel access to positive and negative poles, respectively.

90. The method as set forth in claim 89, wherein the positive poles are connected to the outer track and the negative poles are connected to the inner track.

91. The method as set forth in claim 89, wherein the outer track is 0.5 millimeters from the inner track to allow sufficient clearance between the inner and the outer track.

92. The method as set forth in claim 87, wherein the bonding pads are rectangular shaped with dimensions of 1 millimeter long by 3 millimeters wide.

* * * * *